US005218817A

United States Patent [19]

Urata

[11] Patent Number: 5,218,817

[45] Date of Patent: Jun. 15, 1993

[54] METHOD AND APPARATUS OF PURIFYING EXHAUST GAS FROM INTERNAL COMBUSTION ENGINE

[75] Inventor: Hideo Urata, Saitama, Japan

[73] Assignee: Honda Giken Kogyo Kabushiki Kaisha, Tokyo, Japan

[21] Appl. No.: 868,188

[22] Filed: Apr. 14, 1992

[30] Foreign Application Priority Data

Apr. 26, 1991 [JP] Japan ..... 3-097610

[51] Int. Cl.[5] ..... F01N 3/28

[52] U.S. Cl. ..... 60/274; 60/299; 60/301; 422/172; 422/180

[58] Field of Search ..... 60/299, 301, 274; 422/180, 172, 171

[56] References Cited

U.S. PATENT DOCUMENTS 3,809,743 5/1974 Unland ..... 60/301
3,852,041 12/1974 Moore et al. .
4,209,493 6/1980 Olson .
4,237,099 12/1980 Alley et al. .
5,052,178 10/1991 Clerc ..... 60/297

FOREIGN PATENT DOCUMENTS 57-38765 8/1982 Japan .
59-4529 1/1984 Japan .
62-160726 10/1987 Japan .
63-43564 8/1988 Japan .
1-155015 6/1989 Japan .
2-105518 8/1990 Japan .

*Primary Examiner*—Douglas Hart
*Attorney, Agent, or Firm*—Armstrong, Westerman, Hattori, McLeland & Naughton

[57] ABSTRACT

A catalyst body having carried in a carrier a three way conversion catalyst is disposed inside an exhaust pipe near an exit to the atmosphere. An internal combustion engine is operated in a rich range of air/fuel ratio. Reducing reaction of the exhaust gas takes place in a front portion of the catalyst body. Oxidizing reaction takes place in a rear portion of the catalyst body by intermittently introducing atmospheric air into the catalyst body through pulsations of the exhaust gas.

3 Claims, 3 Drawing Sheets

METHOD AND APPARATUS OF PURIFYING EXHAUST GAS FROM INTERNAL COMBUSTION ENGINE

BACKGROUND OF THE INVENTION

This invention relates to a method of purifying exhaust gas from an internal combustion engine which is mainly used as a prime mover for a small generator, industrial machines, or the like and has a short exhaust system, and to an apparatus therefor.

An apparatus for purifying exhaust gas which uses a three way conversion (hereinafter called TWC) catalyst is conventionally and commonly used in automobiles. This apparatus works effectively in an internal combustion engine in which the air/fuel ratio is highly accurately controlled to a theoretical air/fuel ratio, i.e., to a neighbourhood of A/F=14.6 using an $O_2$ sensor. However, it cannot fully perform its capability in an internal combustion engine in which the air/fuel ratio is not highly accurately controlled.

OBJECT AND SUMMARY OF THE INVENTION

This invention has an object of purifying exhaust gas from an internal combustion engine with a simple means by effectively using a TWC catalyst.

In order to achieve the above-mentioned object, this invention provides a method of purifying exhaust gas from an internal combustion engine in which a catalyst body having carried in a carrier thereof a TWC catalyst is disposed in an exhaust gas passage to reduce and oxidize exhaust gas components, the method comprising the steps of: disposing the catalyst body inside an outlet pipe near an exit which opens into atmosphere, the outlet pipe constituting an outlet end portion of the exhaust gas passage; operating the internal combustion engine in a rich range of air/fuel ratio; generating a reducing reaction in a front portion of the catalyst body; and generating an oxidizing reaction in a rear portion of the catalyst body by intermittently introducing atmospheric air into the catalyst body through pulsations of the exhaust gas.

This invention further provides an apparatus for purifying exhaust gas from an internal combustion engine, the apparatus having a silencer which is provided with one or more expansion chambers within a casing, an inlet pipe for introducing the exhaust gas from the internal combustion engine to one of the expansion chambers, and an outlet pipe for discharging the exhaust gas from one of the expansion chambers to atmosphere, the internal combustion engine being operated in a rich range of air/fuel ratio, wherein a catalyst body in which a TWC catalyst is held carried in a carrier is disposed near an exit of the outlet pipe.

In the above-mentioned method and apparatus, the internal combustion engine is operated in a rich range of air/fuel ratio. Therefore, the upstream side of the catalyst body has very scanty $O_2$, thereby forming a reducing atmosphere and, as a result, the reducing operation of the $NO_x$ is well performed therein. On the other hand, the downstream side of the catalyst body is subjected, through pulsations of the exhaust gas, to intermittent reverse flow of the atmospheric air and discharge of the exhaust gas to and from the exit of the outlet pipe, resulting in good oxidization of HC and CO.

BRIEF DESCRIPTION OF THE DRAWINGS

The above and other objects and the attendant advantages of this invention will become readily apparent by reference to the following detailed description when considered in conjunction with the accompanying drawings wherein.

DETAILED DESCRIPTION OF PREFERRED EMBODIMENTS

Embodying examples of a means to carry out this invention will now be explained with reference to the accompanying drawings.

Figure 1:
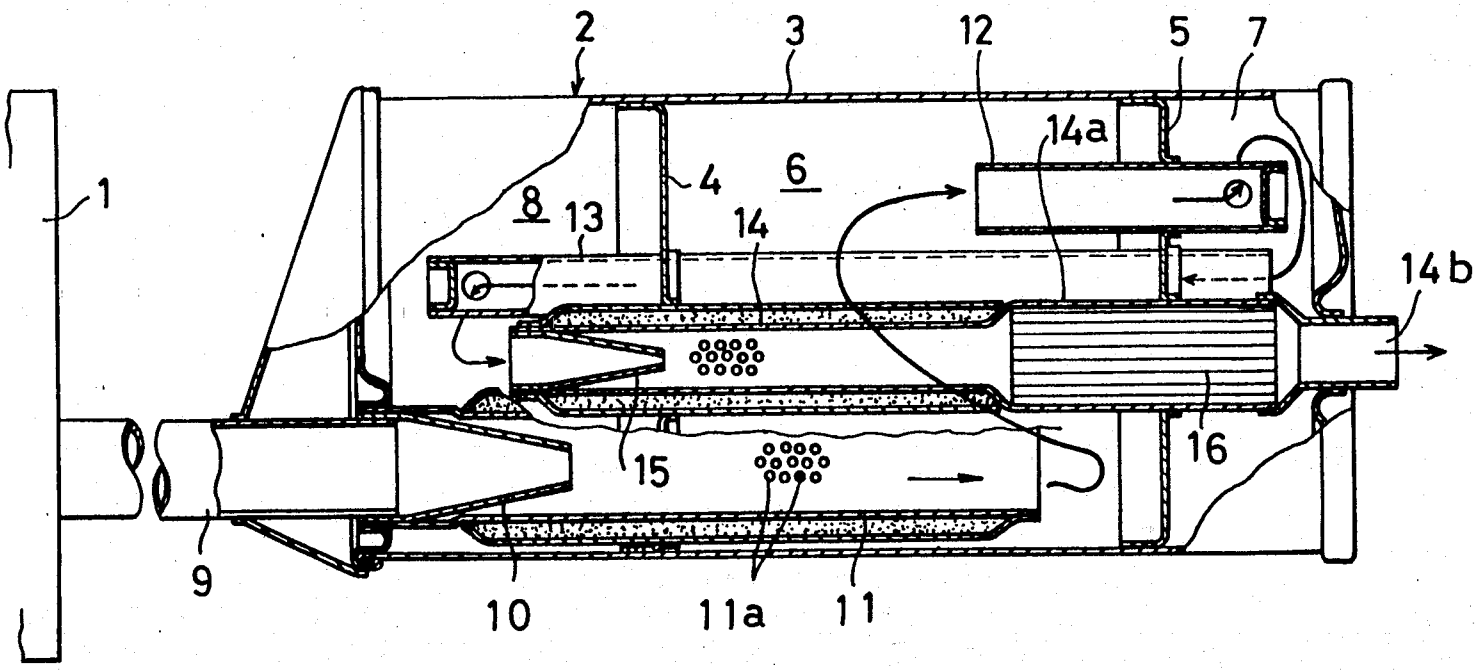
FIG. 1 is a sectional view of an embodiment of this invention.

In FIG. 1, numeral 1 denotes an internal combustion engine and numeral 2 denotes a silencer having therein an apparatus for purifying exhaust gas. This silencer 2 is divided into three expansion chambers 6, 7, 8 by partition walls 4, 5. The expansion chamber 6 is arranged such that the exhaust gas flows thereinto via an inlet pipe 9, a throttle pipe 10 and a damping pipe 11. The exhaust gas then flows into the expansion chambers 7, 8 via connecting pipes 12, 13 which are provided with orifices. The last expansion chamber 8 is provided with an outlet pipe 14 which communicates the expansion chamber 8 with the atmosphere. On an upstream side of the outlet pipe 14 there is provided on an inside thereof a throttle pipe 15. An expanded portion **14*a* on a downstream side of the outlet pipe 14, there is internally disposed a catalyst body 16. It is preferable to provide a multitude of small perforations as typically shown in numeral 11*a* in the damping pipe 11**, on an internal layer of each of the connecting pipes so that acoustic damping can be effected.

The above-mentioned catalyst body 16 comprises a honeycomb-type metallic carrier, and Pt or Pd as an oxidizing catalyst and Rh as a reducing catalyst are respectively held adhered to the metallic carrier. On an upstream side of the catalyst body 16, Rh is distributed or contained in a ratio which is higher when compared to Pt or Pd than, on a downstream side thereof, and Pt or Pd is distributed or contained in a ratio which is higher on the downstream side when compared to Rh. In addition, the catalyst body 16 is disposed in such a manner that its downstream end is located near the exit **14*b* of the outlet pipe 14. Therefore, when negative pressure is generated as a consequence of pulsations of the exhaust gas, the atmospheric air is sucked from the exit 14*b* into the downstream side of the catalyst body 16** to accelerate oxidization of the exhaust gas.

In this embodiment, the internal combustion engine is operated in a rich range of air/fuel ratio and, therefore, exhaust gas relatively rich in unburnt components is introduced into the silencer 2. The exhaust gas passes through the throttle pipes and expansion chambers in a known manner and further through the catalyst body 16. During this passage, the noises and pulsation energy are remarkably reduced and, at the same time, reducing operation of NOx is carried out by both the reducing catalyst and the unburnt components. On the other hand, because the catalyst body 16 is near the exit 14*b*, the atmospheric air is intermittently sucked into the downstream side of the catalyst body 16 and, in cooperation with the oxidizing catalyst, the oxidization of the unburnt components is carried out, thereby discharging purified exhaust gas.

Figure 2:
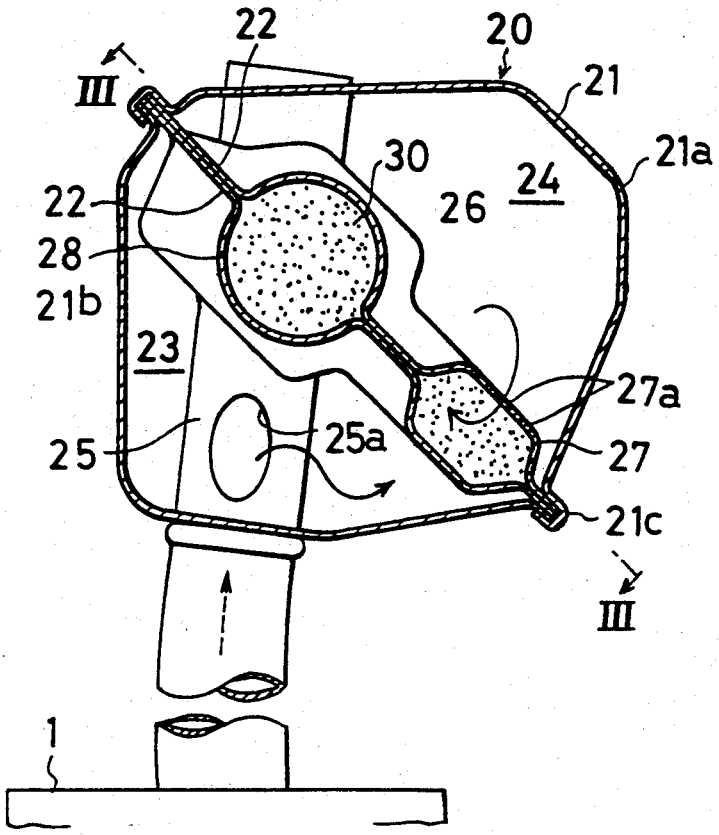
FIG. 2 is a sectional view of another embodiment of this invention.
Figure 3:
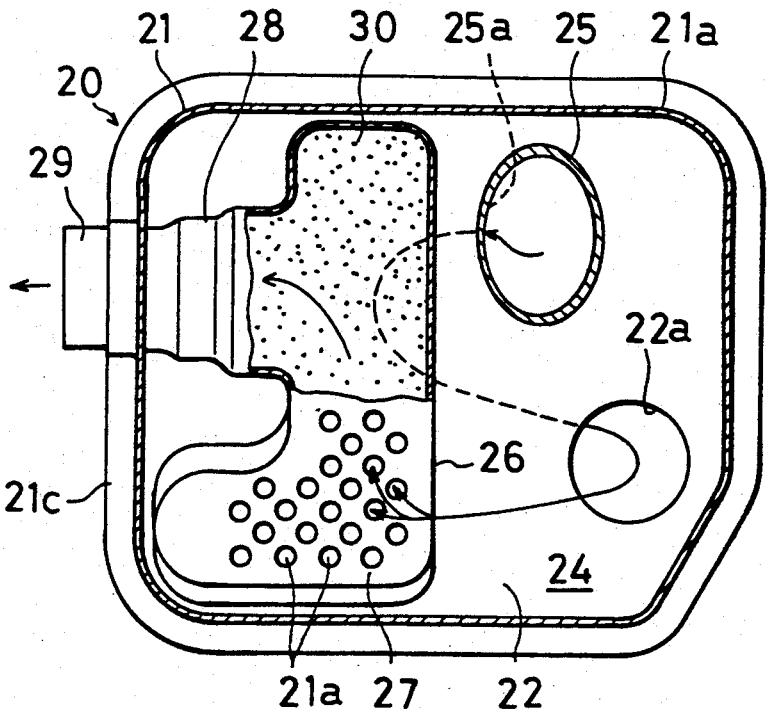
FIG. 3 is a sectional view taken along the line III—III in FIG. 2.

Another embodiment shown in FIGS. 2 and 3 is an example in which a catalyst is disposed in a silencer 20 having two expansion chambers. In this silencer 20, expansion chambers 23, 24 are formed by a casing 21 which comprises two pieces of halves 21*a*, 21*b* which triangular in cross section and two pieces of partition walls 22 which are combined together at caulked portions 21*c*. An inlet pipe 25 having a closed front end is inserted into the casing 21 and fixed thereto. An inlet port 25*a* is opens into the expansion chamber 23, and both expansion chambers 23, 24 are communicated with each other by an opening 22*a* in the partition wall 22.

Numeral 26 denotes a catalyst casing which is formed by expanding part of the two pieces of the partition walls 22 outwards. In this catalyst casing, there are integrally formed an L-shaped inlet portion 27 and an outlet pipe 28 which extends from a longer side of the L-shaped inlet portion. A multitude of small holes 27*a* are formed on one surface of the inlet portion 27 which lies on the side of the expansion chamber 24. A terminal end of the outlet pipe 28 projects out of the casing 21 to form an exit 29.

Inside this catalyst casing 26, there is sealingly contained a catalyst body 30 over a range extending from the internal portion of the small holes 27*a* at the inlet portion 27 up to the outlet 29. The catalyst body 30 comprises a foamed metal carrier which conforms to the internal shape of the catalyst casing 26 and, as mentioned above, Pt or Pd and Rh which are respectively held adhered to the carrier. The exhaust gas inside the casing 21 flows from a multitude of small holes 27*a* into the catalyst body 30 and exits from the exit 29 into the atmosphere. Like in the above-mentioned embodiment, the internal combustion engine 1 is operated in a rich range of air/fuel ratio. The exhaust gas is subjected to a reducing operation on an upstream side of the catalyst body 30 and to an oxidizing operation on a downstream side of the catalyst body 30, respectively. Here, atmospheric air is intermittently sucked into the catalyst body 30 through pulsations of the exhaust gas to accelerate the oxidizing operation.

Figure 4:
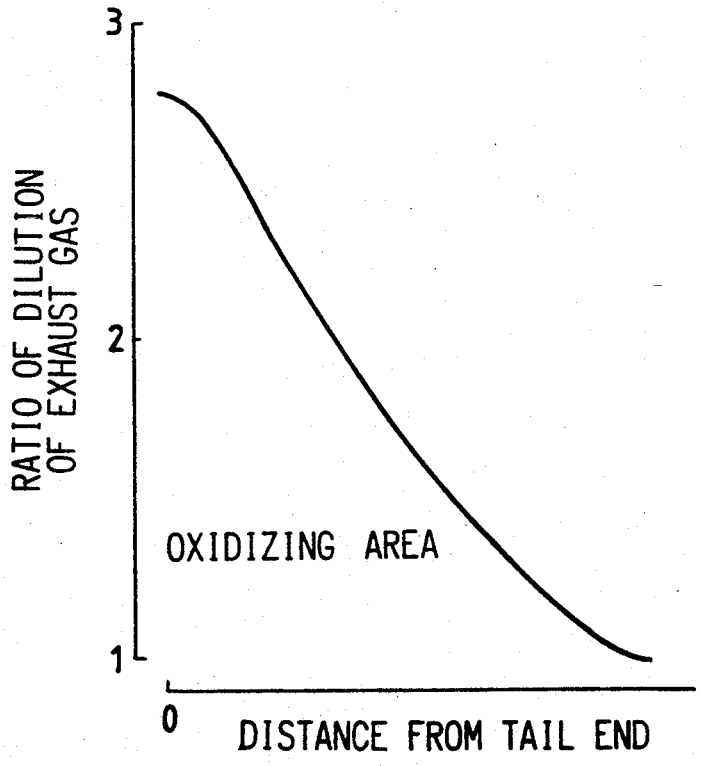
FIG. 4 is a diagram showing the relation between the ratio of dilution of exhaust gas and the distance from the tail end of an outlet pipe.

The ratio of dilution of the exhaust gas inside the outlet pipe 14, 28 by the atmospheric air which is sucked due to pulsations of the exhaust gas is above 2.5 times near the exit 14*b*, 29, as shown in FIG. 4, when the outlet pipe is empty. It follows that the desired oxidization can be carried out by disposing the catalyst body 16, 30 down to an appropriate position near the exit.

As described above, according to this invention, the catalyst body is disposed near the exit of the outlet pipe, and the atmospheric air is introduced into the downstream portion of the catalyst body through the pulsations of the exhaust gas so that, by operating the internal combustion engine in a rich range of air/fuel ratio, the exhaust gas can be treated by the catalyst body. Therefore, the reducing reaction is accelerated by the reducing catalyst in the upstream portion of the catalyst body and the oxidizing reaction is accelerated, in the downstream portion thereof, by both the oxidizing catalyst and the atmospheric air which is reversed by pulsations. As a result the exhaust gas can be purified well.

Since good exhaust gas purification can be carried out without using a high-precision air/fuel ratio control means using an $O_2$ sensor, this invention has an advantage in that the exhaust gas purification apparatus can be manufactured simple in construction and cheap in cost.

It is readily apparent that the above-mentioned method and apparatus for purifying exhaust gas have the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A method of purifying exhaust gas from an internal combustion engine in which a catalyst body having carried in a carrier thereof a three way conversion catalyst is disposed in an exhaust gas passage to reduce and oxidize exhaust gas components, said method comprising the steps of:

disposing said catalyst body inside an outlet pipe near an exit which opens into atmosphere, said outlet pipe constituting an outlet end portion of said exhaust gas passage;

operating the internal combustion engine in a rich range of air/fuel ratio;

generating a reducing reaction in a front portion of said catalyst body; and generating an oxidizing reaction in a rear portion of said catalyst body by intermittently introducing atmospheric air into said catalyst body through pulsations of the exhaust gas, the pulsations generating negative pressure in said outlet pipe causing atmospheric air to be drawn into the catalyst body via the exit of the outlet pipe.

2. An apparatus for purifying exhaust gas from an internal combustion engine, said apparatus having:

a silencer which is provided with one or more expansion chambers within a casing, an inlet pipe for introducing the exhaust gas from the internal combustion engine to one of said expansion chambers, an outlet pipe for discharging the exhaust gas from one of said expansion chambers to atmosphere, a catalyst body in which a three way conversion catalyst on a carrier is disposed near an exit of said outlet pipe, and means for oxidizing a rear portion of the catalyst body comprising means for intermittently introducing atmospheric air into the catalyst body through pulsations of exhaust gas and generating negative pressure in the outlet pipe causing atmospheric air to be drawn into the catalyst body via the exit of the outlet pipe.

3. An apparatus for purifying exhaust gas according to claim 2, wherein said three way conversion catalyst is arranged such that a ratio of reducing catalyst to oxidizing catalyst is higher on an upstream side of said catalyst body than on a downstream side of said catalyst body and that a ratio of oxidizing catalyst to reducing catalyst is higher on the downstream side of said catalyst body than on the upstream of said catalyst body.

* * * * *